United States Patent [19]

Butler

[11] 4,173,755

[45] Nov. 6, 1979

[54] BATTERY-OPERATED BODY CAPACITANCE INTRUSION ALARM APPARATUS

[76] Inventor: George N. Butler, 4720 NW. 5 La., Boca Raton, Fla. 33431

[21] Appl. No.: 883,390

[22] Filed: Mar. 6, 1978

Related U.S. Application Data

[63] Continuation of Ser. No. 792,887, May 2, 1977, abandoned.

[51] Int. Cl.[2] ..... G08B 13/26

[52] U.S. Cl. ..... 340/562; 330/250; 331/65; 331/108 R

[58] Field of Search ..... 340/562; 331/65, 108 R; 330/250

[56] References Cited

U.S. PATENT DOCUMENTS

| | | | |
|---|---|---|---|
| 3,465,325 | 9/1969 | Goldfarb et al. | 340/562 |
| 3,549,905 | 12/1970 | Johnson | 340/562 |
| 3,594,786 | 7/1971 | Brunner-Schwer et al. | 340/384 E |
| 4,091,371 | 5/1978 | Mason, Jr. et al. | 340/546 |

*Primary Examiner*—Glen R. Swann, III

*Attorney, Agent, or Firm*—Oltman and Flynn

[57] ABSTRACT

An intrusion alarm having an oscillator which is turned off by the body capacitance of a would-be intruder operates in the frequency range of 17–65 MHz. At this frequency, reliable discrimination between body capacitance and stray capacitance is possible and therefore sensitivity is increased while false alarms are reduced. Battery life is increased by providing a high resistance load in the stand-by mode to reduce battery drain to 500 microamperes or less. Latching and nonlatching embodiments are disclosed.

8 Claims, 4 Drawing Figures

Fig. 1
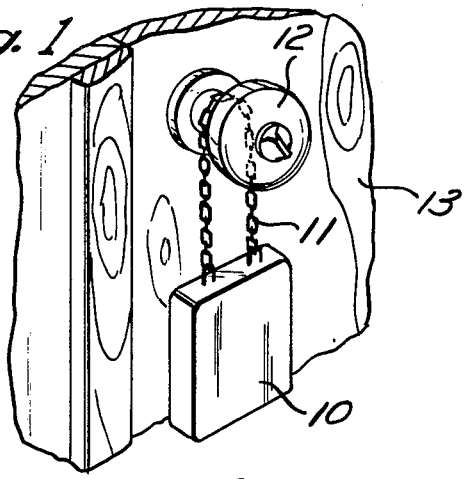
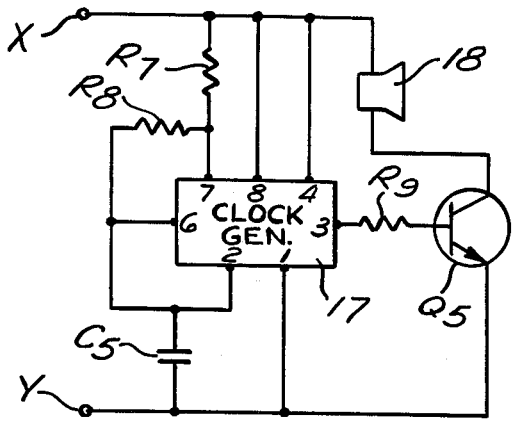
Fig. 4
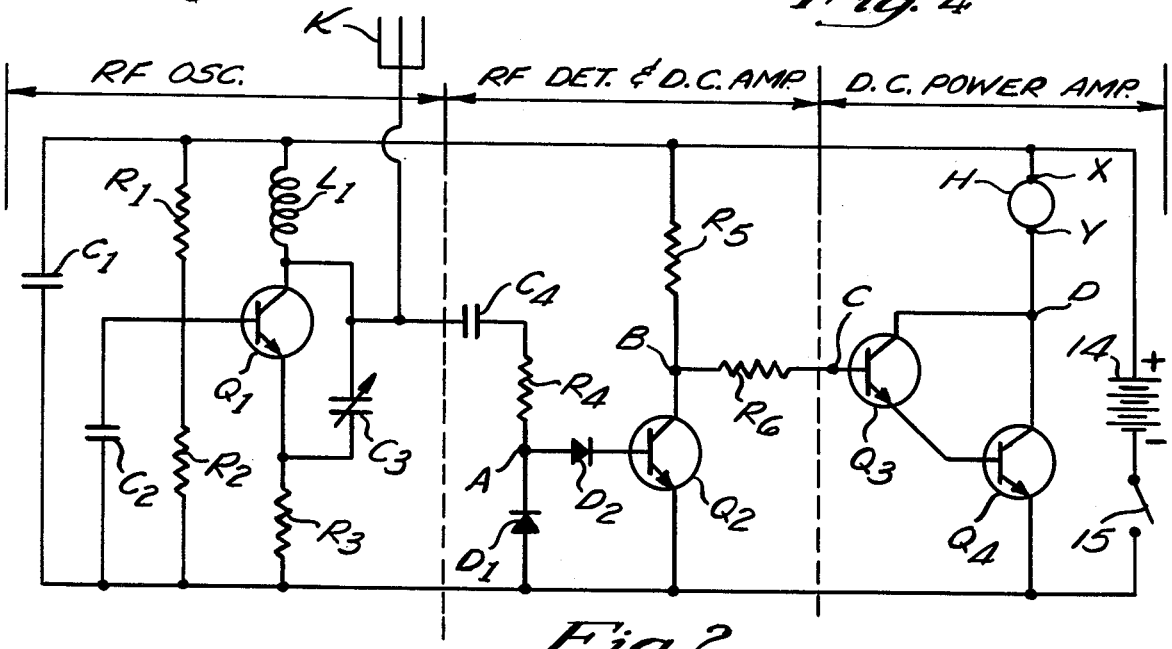
Fig. 2
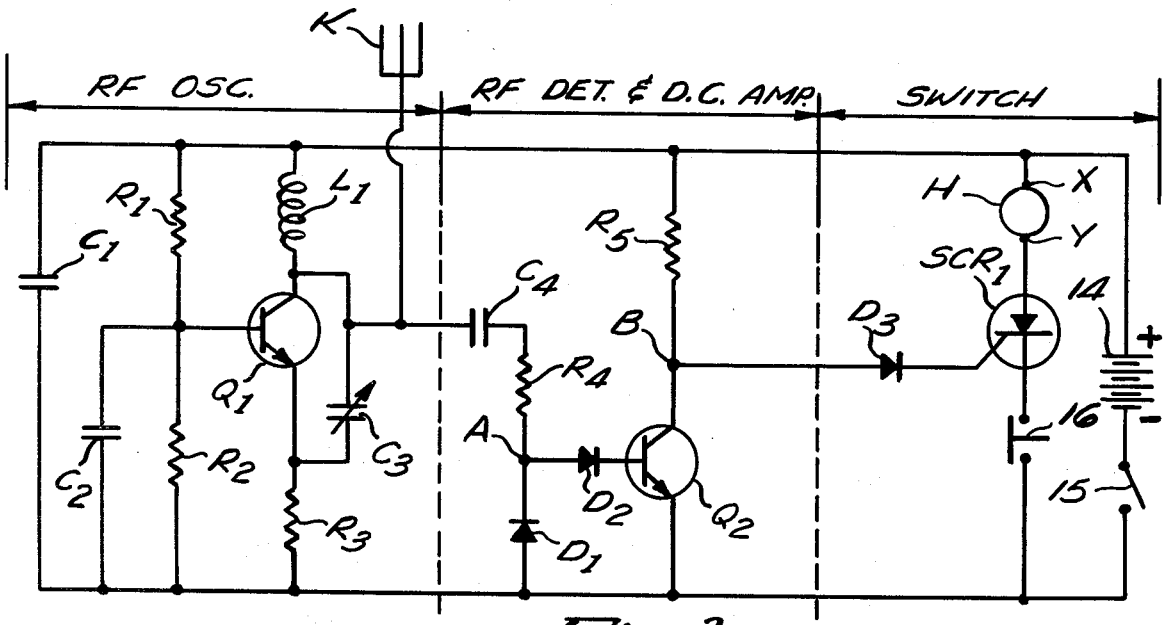
Fig. 3

BATTERY-OPERATED BODY CAPACITANCE INTRUSION ALARM APPARATUS

CROSS REFERENCE TO RELATED APPLICATION

This application is a continuation of my copending U.S. Pat. application, Ser. No. 792,887, filed May 2, 1977, now abandoned, which had an internal inconsistency between the oscillator frequency as computed from the values given for the frequency-determining circuit elements of the oscillator and the oscillator frequency as determined by an evidently faulty frequency measuring arrangement used by me.

BACKGROUND OF THE INVENTION

Various alarm devices have been proposed heretofore which produce an audible or other alarm signal when a person touches the outside doorknob of a door leading into the premises to be protected.

Examples of such prior proposals in which the alarm apparatus is A.C. powered are disclosed in my U.S. Pat. No. 4,011,554, "Popular Electronics" magazines, Feb. 1969, pp. 92–93, U.S. Pat. No. 3,508,239 to John V. Fontaine, and U.S. Pat. No. 3,465,325 to Goldfarb et al.

Examples of such prior proposals in which the alarm apparatus is battery powered are disclosed in U.S. Pat. No. 3,623,063 to John V. Fontaine, and in "101 Electronic Projects For Under $15", a Davis Publication, 1975 edition, pp. 56–57. The previous battery powered intrusion alarms had two principal disadvantages: short battery life, and frequent false alarms caused by an inability to reliably discriminate between the capacitance of a person's body and various stray capacitances.

SUMMARY OF THE INVENTION

I have discovered that the successful, reliable performance of a battery-operated intrusion alarm apparatus having an oscillator which is turned off by the body capacitance of a would-be intruder depends critically upon the oscillator frequency. The critical operative range, from about 17 MHz. up to about 65 MHz., is much higher than the frequency of operation of previous battery powered alarms of this general type. Within this critical oscillator frequency range the alarm apparatus is sufficiently sensitive to respond to a person's touching or closely approaching the sensor of the apparatus. This would include touching the doorknob with a key or other metal object or with a heavy rubber or fabric glove. Also, it can discriminate dependably between the body capacitance of a person and stray capacitances, thereby preventing false alarms.

Another critical advantage of my alarm apparatus is that the standby current or current drain when the apparatus is in its normal, non-alarm condition is less than 500 microamperes, thereby prolonging the life of the battery.

My alarm apparatus has a fail-safe mode of operation which causes the oscillator to turn off and signal an apparent alarm condition continuously when the battery voltage drops below a certain value. This continuous apparent alarm condition tells the user that the battery is dying and should be replaced immediately.

A principal object of this invention is to provide a novel and improved battery-operated intrusion alarm apparatus.

Another object of this invention is to provide such an alarm apparatus having a front end oscillator operating in what I have determined is a critical frequency range between approximately 17 MHz. and 65 MHz. A sensor is connected in the feedback circuit of the oscillator. The oscillator will be turned off to trigger an alarm by the body capacitance of a would-be intruder who touches or closely approaches the sensor. However, in this frequency range the oscillator will not be turned off by ambient stray capacitances usually encountered.

Another object of this invention is to provide a novel and improved battery-operated intrusion alarm apparatus having an extremely low current drain which prolongs the life of the battery.

Further objects and advantages of this invention will be apparent from the following detailed description of two presently-preferred embodiments thereof, which are shown in the accompanying drawings.

BRIEF DESCRIPTION OF THE DRAWING

FIG. 1 is a perspective view showing the present alarm apparatus suspended from the inside doorknob on a door;

FIG. 2 is a schematic electrical circuit diagram of a non-latching embodiment of the present alarm apparatus; and FIG. 3 is a schematic electrical circuit diagram of a latching embodiment of the present alarm apparatus; and FIG. 4 is a schematic electrical circuit diagram of the alarm signalling device H in either FIG. 2 or FIG. 3.

DESCRIPTION OF THE PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Referring first to FIG. 1, the present alarm apparatus has a small housing 10 with a chain 11 of electrically conductive metal by which it is suspended from an electrically conductive metal doorknob 12 on the inside of a door 13 of wood or other suitable electrically non-conductive material. Enclosed within the housing 10 are all of the components of the electrical circuit shown in FIG. 2 (or the circuit shown in FIG. 3) except the sensor K, which includes the chain 11, the inside doorknob 12, and the doorknob (not shown) on the outside of the door.

It is to be understood that instead of the doorknobs and chain, the sensor for the present alarm might have a floor mat or any other suitable arrangement electrically coupled to the present alarm circuit to introduce more capacitance or electrical grounding into the alarm circuit to trigger the alarm.

Referring to FIG. 2, the circuit shown there has three principal stages: an RF oscillator, an RF detector and DC amplifier, and a DC power amplifier.

The RF oscillator includes a transistor $Q_1$ whose collector is connected to the positive terminal of a battery 14 through an inductance $L_1$. The emitter of $Q_1$ is connected to the negative terminal of battery 14 through a load resistor $R_3$ and a manual on-off switch 15. A feedback capacitor $C_3$ is connected across the collector and emitter of $Q_1$. A bias resistor $R_1$ is connected between the positive battery terminal and the base of $Q_1$. Another bias resistor $R_2$ is connected between the base of $Q_1$ and the negative battery terminal. A bypass capacitor $C_1$ is connected across the battery terminals via switch 15, and another bypass capacitor $C_2$ is connected across resistor $R_2$.

The sensor K is directly connected conductively to the collector of $Q_1$.

The feedback capacitor $C_3$ is selected or factory-adjusted to provide a 90-degree phase shift between the collector and emitter of $Q_1$ normally (i.e., in the absence of a person's touching or closely approaching the outside doorknob which is part of the sensor K).

In the presently preferred embodiment of this oscillator the circuit elements have the following identity and values:

| | |
|---|---|
| $Q_1$ | type 2N 4401 |
| $C_1$ | .047 microfarad |
| $C_2$ | .047 microfarad |
| $R_1$ | 87,000 ohms |
| $R_2$ | 22,000 ohms |
| $R_3$ | 2,000 ohms |
| $L_1$ | 1.2 microhenries |
| $C_3$ | 5–75 picofarads |

Using the well-known equation for resonance, in this circuit the resonant frequency $=\frac{1}{2}\pi\sqrt{L_1C_3}$. When $C_3$ is at its lower limit of 5 picofarads the oscillator frequency is substantially 65 MegaHertz. When $C_3$ is at its upper limit of 75 picofarads the oscillator frequency is substantially 17 MHz.

Within this critical frequency range from substantially 17 MHz. to 65 MHz. the oscillator will turn off when a person touches or closely approaches the outside doorknob. The person's body capacitance of approximately 100 picofarads connects the sensor K to neutral potential and prevents the feedback capacitor $C_3$ from continuing to provide the 90 degree phase shift required for oscillations to be maintained. At an oscillator frequency of at least substantially 17 megahertz or higher the normal body capacitance of a human being is seen by the oscillator as a high enough impedance that it can be distinguished from ambient stray capacitance at the sensor K or stray circuit capacitance within housing 10.

The sensitivity of the oscillator to a person's touching or closely approaching the outside doorknob or any other part of the sensor K increases as the oscillator frequency is increased. However, at oscillator frequencies substantially above 65 MHz. the apparatus would be so sensitive that the oscillator might be turned off by a person who is a foot or more away from the sensor, and sometimes by stray capacitances. At frequencies substantially below 17 MHz. the oscillator is not able to discriminate reliably between a person's body capacitance and stray capacitances, resulting in annoying frequent false alarms which made impractical the previously proposed alarms which operated at such lower frequencies.

The detector-amplifier stage of the FIG. 2 circuit includes a coupling capacitor $C_4$ connected directly to the collector of $Q_1$ and a resistor $R_4$ connected between capacitor $C_4$ and a point A in the circuit. A first rectifier $D_1$ has its cathode connected to point A and its anode connected through switch 15 to the negative terminal of battery 14. A second rectifier $D_2$ has its anode connected to point A and its cathode connected to the base of a transistor $Q_2$. The emitter of $Q_2$ is connected to the negative battery terminal through switch 15. The collector of $Q_2$ is connected through a load resistor $R_5$ to the positive battery terminal.

To the right of point A in FIG. 2 the circuit is entirely DC.

Resistor $R_4$ provides a load for the oscillator and provides an impedance match between the oscillator stage and the detector-amplifier stage.

The load resistor $R_5$ for $Q_2$ has a high enough resistance (at least 47,000 ohms) to hold the current to a satisfactorily low level for long battery life.

While the oscillator is oscillating a small DC voltage appears at point A, due to the rectifying action of $D_1$, and this is sufficient to turn on $Q_2$. When $Q_2$ conducts, the voltage from its collector to ground is about 0.7 volts in the preferred embodiments of this circuit. Because this voltage (at point B) is held at this level, the Darlington combination $Q_3$–$Q_4$ of the power amplifier stage is normally maintained in a cutoff condition. Point B (at the collector of $Q_2$) is connected to point C (at the base of $Q_3$) through a resistor $R_6$. The collector of $Q_3$ is connected to the collector of $Q_4$ at point D. The emitter of $Q_3$ is connected to the base of $Q_4$. The emitter of $Q_4$ is connected to the negative battery terminal through switch 15. Point D is connected through an electrically operated alarm signalling device H to the positive battery terminal.

With the Darlington combination $Q_3$–$Q_4$ of the D.C. power amplifier stage cut off as long as the oscillator is oscillating, the leakage current through the alarm signalling device H is extremely low, virtually zero.

Preferably, the overall current gain from point A to point D is at least 125,000.

In the embodiment of the invention having the oscillator circuit elements already identified, the values and identities of the circuit elements in the RF detector and DC amplifier stage and the DC power amplifier stage of the circuit are as follows:

| | |
|---|---|
| $C_4$ | .01 microfarads |
| $R_4$ | 560 ohms |
| $D_1$ & $D_2$ | type 1N 4148 |
| $R_5$ | 47,000 ohms |
| $R_6$ | 1,000 ohms |
| $Q_2$, $Q_3$ & $Q_4$ | type 2N 4401 |
| battery 14 | four series-connected 1.5 volt "c" cells |

In the operation of this circuit, the signalling device H sounds an alarm when the Darlington combination $Q_3$–$Q_4$ is turned on. This happens as a result of cessation of oscillations in the oscillator when a person touches or closely approaches the sensor K. Normally, i.e., while the oscillator is oscillating, the current drain through the signalling device H is extremely low and as a consequence the battery life is exceptionally long.

The circuit functions in a fail-safe manner in that when the battery begins to die and its voltage drops, the oscillator will be turned off and the signalling device H will be turned on. (The battery voltage will still be high enough to operate the signalling device H.) Typically the signalling device at first will produce intermittent short bursts of sound and gradually it stays on continuously. This tells the user (after determining that a would-be intruder has not triggered the alarm) that the battery is dying and should be replaced.

In one practical embodiment, the actual voltage of the four series-connected 1.5 volt "c" cells, when fresh, is 6.1 volts and the current drain (in the absence of an alarm condition) is 470 microamperes. After a period of use, the battery voltage drops to 5.5 volts and the current drain is 400 microamperes. Later, the battery voltage is down to 5.0 volts and at this voltage the current drain is 370 microamperes. When the battery voltage is down to 4.9 volts the current drain is 310 microamperes.

The apparatus continues to function properly for alarm signalling purposes until the battery voltage is down to 4.6 volts, at which point the current drain is 280 microamperes. At this cutoff point of 4.6 volts battery voltage, the detector is disabled and the alarm signalling device H comes on and stays on, at first intermittently and later continuously, even when a person is not touching or close to the sensor K. This continuous apparent alarm condition persists until the battery voltage drops to about 3.0 volts, and its continuity tells the user that the battery needs replacement.

In practice, conventional lead-zinc batteries can be expected to last eight months before requiring replacement in the present alarm apparatus. The useful life of alkaline batteries in the present alarm apparatus is two years or more. Such long battery life is achieved by keeping the current drain at a very low value, preferably under 500 microamperes. In the present alarm apparatus this is achieved by using transistors having a high Beta (current amplification), at least 150. In the FIG. 2 circuit, $Q_1$, $Q_2$, $Q_3$ and $Q_4$ all have this high Beta characteristic.

It is to be understood that all of the circuit components, including the battery 14 and switch 15, are electrically insulated from the casing 10.

FIG. 3 shows a modified circuit of the "latching" type, in which the alarm signalling device H, once it turns on, will remain on until the user deliberately turns it off.

The oscillator stage and the RF detector—DC amplifier stage are the same as in FIG. 2 and need not be described again.

The final stage of the FIG. 3 circuit is termed a "switch" stage, having a silicon controlled rectifier $SCR_1$ with its gate electrode connected to point B through a rectifier $D_3$. The positive battery terminal is connected through the alarm signalling device H to the anode of $SCR_1$. The cathode of $SCR_1$ is connected through a normally-closed, push-button switch 16 and switch 15 to the negative battery terminal.

As long as the oscillator is oscillating, the output of $Q_2$ will hold the gate of $SCR_1$ almost at ground potential and $SCR_1$ will be off. When the oscillator stops oscillating, as described, this cutoff bias no longer appears on the gate of $SCR_1$ and the latter turns on, passing sufficient current through the alarm signalling device H to cause the latter to sound the alarm.

Even if the oscillator resumes oscillating, $SCR_1$ will remain on until the user depresses the push button of switch 16 to open this switch. As soon as this push button is released and switch 16 re-closes the circuit will be restored to its normal operating condition with the signalling device H turned off and the oscillator oscillating.

In the presently-preferred embodiment of FIG. 3, the circuit elements which are the same as those in FIG. 2 have the same values and are the same type as in the FIG. 2 circuit. In addition, $SCR_1$ is a Hudson 106 $D_1$ silicon controlled rectifier.

The performance characteristics of the FIG. 3 alarm circuit are essentially similar to those of the FIG. 2 circuit already described. The current drain preferably is less than 500 microamperes, both transistors $Q_1$ and $Q_2$ have a high Beta, and the oscillator frequency is between substantially 17 and 65 MHz. All of the circuit components in FIG. 3, including the battery 14 and both switches 15 and 16, are electrically insulated from the casing 10.

The alarm signalling device H in FIGS. 2 and 3 is shown in detail in FIG. 4.

It includes an NE 555 integrated circuit 17 of known design which generates clock pulses, a transistor $Q_5$ for amplifying these pulses and an 8-ohm speaker 18 of conventional design for broadcasting these amplified pulses audibly. The pulse repetition rate preferably is about 1,000 Hz. as determined by the value of resistors $R_7$ and $R_8$ and capacitor $C_5$. A load resistor $R_9$ is connected between the output terminal of clock pulse generator 17 and the base of $Q_5$.

In one practical embodiment, $Q_5$ is a 2N4401 transistor (the same as transistors $Q_1$, $Q_2$, $Q_3$ and $Q_4$), resistor $R_7$ is 1,000 ohms, resistor $R_8$ is 7,250 ohms, resistor $R_9$ is 47 ohms, and capacitor $C_5$ is 0.047 microfarad (the same as capacitor $C_2$).

I have determined that the alarm signalling device of FIG. 4, when connected in the FIG. 2 circuit or the FIG. 3 circuit with its terminals X and Y as shown, enable the circuit to operate as described, both for normal alarm signalling and also for signalling that the battery is dying and needs replacement. In contrast, a conventional 6-volt or 3-volt buzzer would not work in this fashion when connected in the FIG. 2 circuit or the FIG. 3 circuit between the terminals X and Y.

It will be understood that in both the non-latching embodiment (FIG. 2) and the latching embodiment (FIG. 3) various changes may be made in the circuitry. For example, in the RF detector—DC amplifier stage the transistor $Q_2$ might be changed to a PNP transistor, in which case rectifier $D_2$ would be reversed and a large resistor would be connected between the base and emitter of $Q_2$ to provide the complement of the NPN arrangement shown.

I claim:

1. In a battery-operated intrusion alarm apparatus having:

a battery;

an oscillator energized by said battery to normally produce oscillations;

a sensor operatively coupled to said oscillator to stop said oscillations in response to the body capacitance of a person touching or in close proximity to the sensor; and means operatively coupled to said oscillator for signalling an alarm when it stops oscillating;

the improvement which comprises means for causing said oscillator to oscillate at a predetermined frequency within the range from substantially 17 MegaHertz to 65 MegaHertz.

2. An alarm apparatus according to claim 1, and further comprising means for limiting the current drain on the battery to less than substantially 500 microamperes while said oscillator is oscillating.

3. An alarm apparatus according to claim 2, wherein said oscillator is operative to stop oscillating and thereby operate said alarm signalling means when the voltage of said battery drops below a predetermined value.

4. An alarm apparatus according to claim 1, wherein:

said oscillator includes a transistor having a Beta of at least 150;

and further comprising:

an RF detector and DC amplifier having a transistor with a Beta of at least 150 coupling said oscillator to said means for signalling an alarm.

5. An alarm apparatus according to claim 4, and further comprising:

a DC power amplifier coupling said RF detector and DC amplifier to said means for signalling an alarm, said power amplifier including a Darlington pair of two transistors each having a Beta of at least 150.

6. An alarm apparatus according to claim 4, and further comprising:

an SCR;

a rectifier connecting the output of said RF detector and DC amplifier to the gate of said SCR to turn on said SCR when said oscillator stops oscillating; and a manually operated switch connected in series with said SCR and said means for signalling an alarm across said battery, whereby to maintain said last-mentioned means energized through said SCR even if said oscillator resumes oscillating until, said switch is opened.

7. An alarm signalling apparatus according to claim 5 wherein:

said alarm signalling device is connected between the positive battery terminal and said Darlington pair and comprises:

a clock pulse generator;

a transistor coupled to the output of said pulse generator to amplify its pulses; and a speaker operatively connected to said last-mentioned transistor for audibly broadcasting the amplified pulses.

8. An alarm signalling apparatus according to claim 6 wherein:

said alarm signalling device is connected between the positive battery terminal and said SCR and comprises:

a clock pulse generator;

a transistor coupled to the output of said pulse generator to amplify its pulses; and a speaker operatively connected to said last-mentioned transistor for audibly broadcasting the amplified pulses.

* * * * *